United States Patent [19]

Simeonoff

[11] 4,372,522

[45] Feb. 8, 1983

[54] SECTIONAL WALL FORM SYSTEM

[76] Inventor: George Simeonoff, 191 King St., Weston, Ontario, Canada, M9N 1L8

[21] Appl. No.: 232,964

[22] Filed: Feb. 9, 1981

[51] Int. Cl.[3] ..... E04G 11/08; E04G 17/04

[52] U.S. Cl. ..... 249/18; 52/578; 52/582; 108/64; 108/107; 211/186; 249/44; 249/47

[58] Field of Search ..... 249/18, 19, 22, 33, 249/210, 219 R, 36, 44, 47, 187, 189, 191, 192, 207, 6, 16, 25-27, 36, 40, 45, 189, 194, 196; 52/578, 582, 497, 448, 581, 488, 348, 667; 108/64, 107; 211/186, 187

[56] References Cited

U.S. PATENT DOCUMENTS

| | | | |
|---|---|---|---|
| 2,715,257 | 8/1955 | Symons | 249/191 |
| 2,976,597 | 3/1961 | Elam | 249/47 |
| 2,997,769 | 8/1961 | Bowden | 249/219 R |
| 3,067,479 | 12/1962 | Schimmel | 249/192 |
| 3,137,909 | 6/1964 | Bonin et al. | 249/191 |
| 3,171,186 | 3/1965 | Bowden | 249/191 |
| 3,204,918 | 9/1965 | Bonin et al. | 249/191 |
| 3,241,802 | 3/1966 | Lawrence | 249/47 |
| 3,357,673 | 12/1967 | Williams | 249/33 |
| 3,477,684 | 11/1969 | Dagiel | 249/219 R |
| 3,565,474 | 2/1971 | Stumbo et al. | 52/667 |
| 3,664,630 | 5/1972 | Maynen et al. | 249/47 |
| 3,833,199 | 9/1974 | Frake | 249/33 |

FOREIGN PATENT DOCUMENTS

| | | | |
|---|---|---|---|
| 1902568 | 1/1971 | Fed. Rep. of Germany | 249/192 |

*Primary Examiner*—Willard E. Hoag

*Attorney, Agent, or Firm*—Stefan V. Stein

[57] ABSTRACT

A sectional wall form system is disclosed for forming concrete walls or the like. Basically, the wall form system comprises a plurality of channel panels which are serially connected together in a side-by-side relationship by means of a plurality of lock brackets. Each lock bracket comprises a substantially rectangular configuration dimensioned to closely fit between the side portions of the channel panels. A pair of L-shaped locking rods are welded to the underside of each of the lock brackets and extend from one edge thereof. A pair of locking apertures is located in the other edge of each of the lock brackets. During assembly, the channel panels are placed in a side-by-side relationship. An intermediate lock bracket is placed in a position substantially parallel to the side portion of an intermediate channel panel enabling the locking rod to engage into respective apertures in the side portion of the intermediate and the succeeding channel panel. The lock bracket is moved downwardly to a position transverse to the intermediate panel thereby causing the locking rods to fully engage through the respective locking apertures in the side portions. A succeeding lock bracket is then similarly positioned within the succeeding channel panel to engage the corresponding apertures in the side portion of the succeeding channel panel. When moved to a position transverse to the succeeding channel panel, the lock apertures located within the succeeding lock bracket are engaged by the locking rods of the intermediate lock bracket. This procedure is continued until all of the channel panels are interlocked with one another by means of a plurality of lock brackets.

14 Claims, 8 Drawing Figures

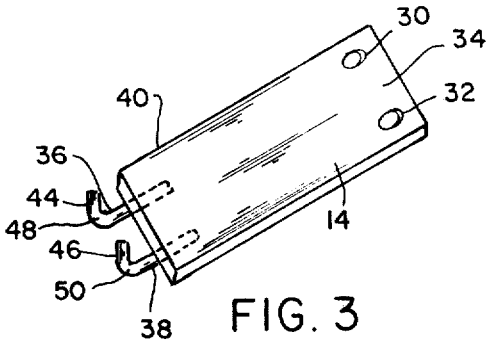
FIG. 3
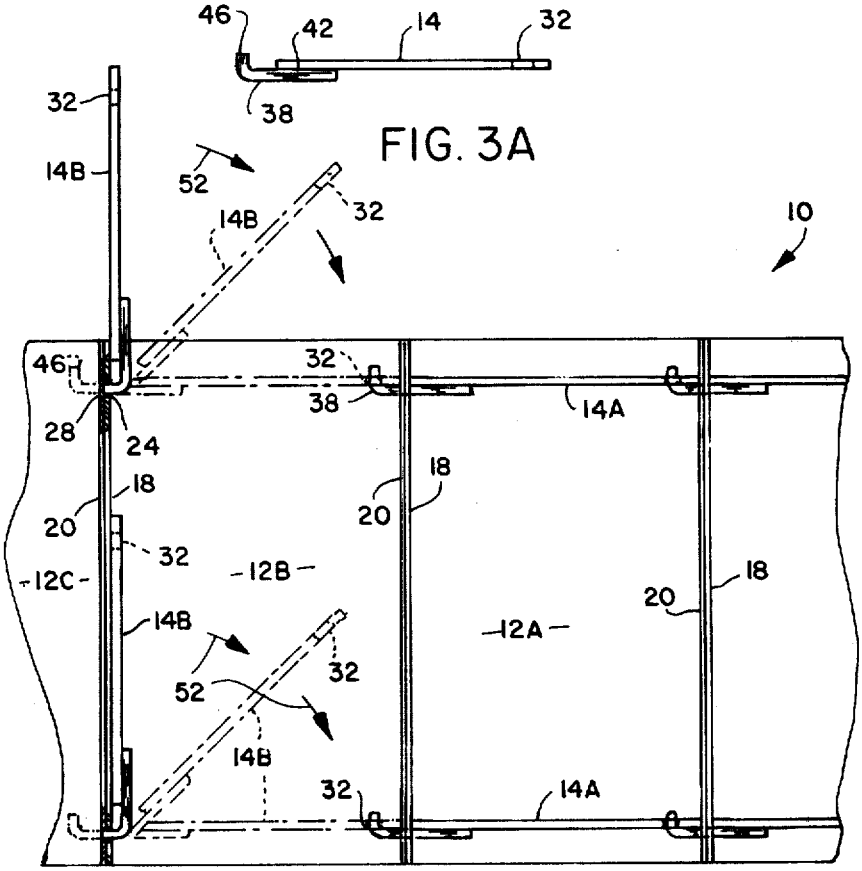
FIG. 3A
FIG. 4

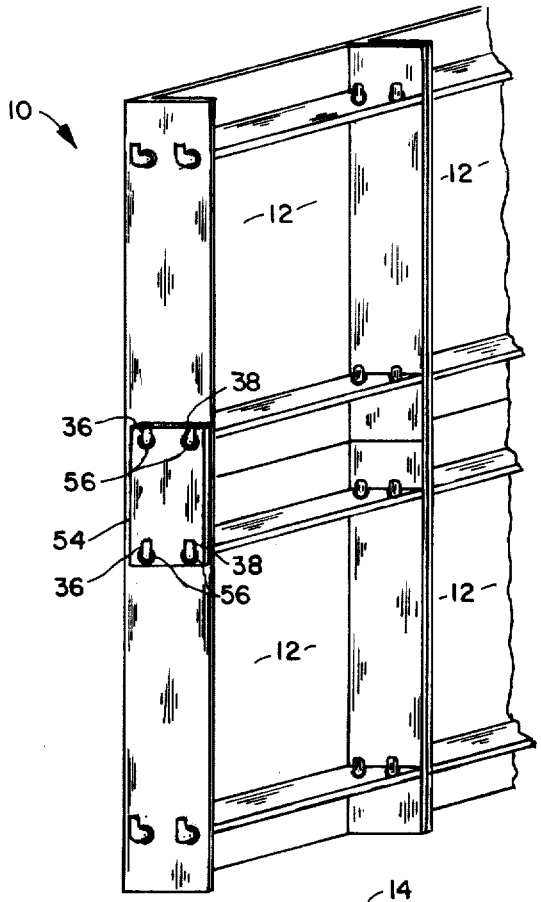
FIG. 5
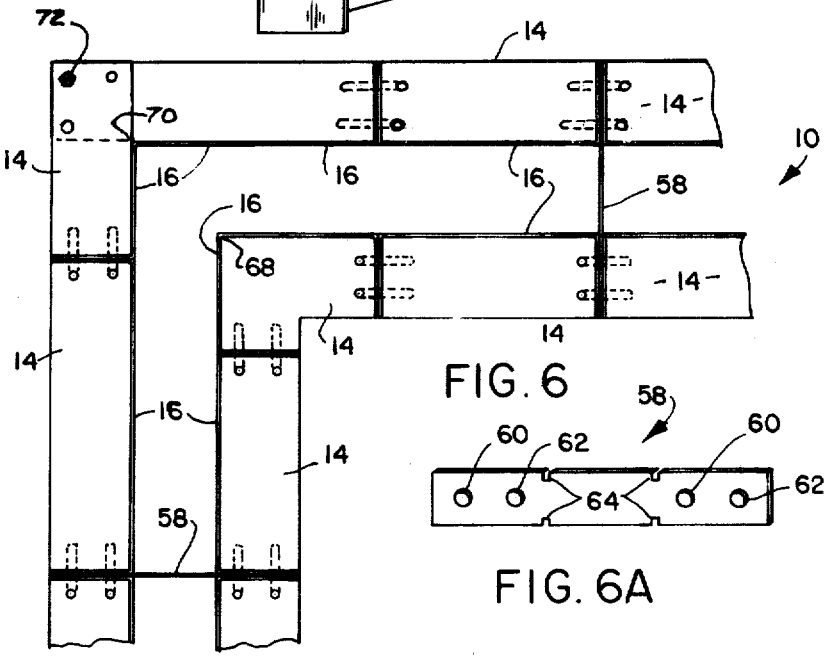
FIG. 6
FIG. 6A

SECTIONAL WALL FORM SYSTEM

BACKGROUND OF THE INVENTION

1. Field of the Invention

This invention relates to sectional wall form systems. More particularly, this invention relates to sectional wall form systems which are easily assembled and disassembled without the need of hardware or tools.

2. Description of the Prior Art

Presently there exists many types of wall form systems for forming concrete walls or the like. Basically, these prior art systems comprise a plurality of modular sections which are serially connected together in a side-by-side relationship by fastener means such as threaded fasteners or clamps. For example, U.S. Pat. No. 3,550,098, teaches a modular system wherein the panels are connected together in a side-by-side relationship by means of a plurality of clamps which secures the sides of the panels together. A wedge is provided to be inserted into a slot in the clamp to tighten the same. U.S. Pat. No. 3,447,771 teaches a similar clamping device which includes a peg which is inserted through holes in the sides of the panels and secured in place by means of a wedge inserted within a corresponding slot in the peg. Finally, U.S. Pat. No. 618,039 teaches still another type of clamp which is positioned over the edges of the panels to secure the panels in place.

An obvious disadvantage of each of the above-mentioned patents is the use of clamps and other associated components such as wedges to secure the edges of the panels together. The clamps increase the complexity and cost of interconnecting the series of panels. Moreover, the clamps and their associated components are typically lost or misplaced during assembly or disassembly thereby further increasing the overall cost of using such a system.

Therefore it is an object of this invention to provide an apparatus which overcomes the aforementioned inadequacies of the prior art devices and provides an improvement which is a significant contribution to the advancement of the wall form system art.

Another object of this invention is to provide a wall form system which is economical to manufacture.

Another object of this invention is to provide a wall form system having no component parts such as clamps which may be lost during assembly or disassembly.

Another object of this invention is to provide a wall form system having a plurality of panels which are interconnected together in a side-by-side relationship by means of a plurality of lock brackets.

Another object of this invention is to provide a wall form system wherein the lock brackets increase the overall strength and rigidity of the interlocked panels.

Another object of this invention is to provide a wall form system wherein the lock brackets enable an operator to easily and quickly interconnect a series of panels without the need of special tools or hardware.

Another object of this invention is to provide a wall form system including corner channel panels having face portions bent to form an inside or an outside corner in the wall to be formed.

The foregoing has outlined some of the more pertinent objects of the invention. These objects should be construed as merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description describing the preferred embodiment, in addition to the scope of the invention defined by the claims taken in conjunction with the accompanying drawings.

SUMMARY OF THE INVENTION

The invention is defined by the appended claims with a specific embodiment shown in the attached drawings. For the purpose of summarizing the invention, the invention comprises a plurality of channel panels which are serially connected together in a side-by-side relationship by means of a plurality of lock brackets. Each lock bracket comprises a substantially rectangular configuration dimensioned to closely fit between the side portions of the channel panels. A pair of L-shaped locking rods are welded to the underside of each of the lock brackets and extend from one edge thereof. A pair of locking apertures is located in the other edge of each of the lock brackets. During assembly, the channel panels are placed in a side-by-side relationship. An intermediate lock bracket is placed in a position substantially parallel to the side portion of an intermediate channel panel enabling the locking rod to engage into respective apertures in the side portion of the intermediate and the succeeding channel panel. The lock bracket is moved downwardly to a position transverse to the intermediate panel thereby causing the locking rods to fully engage through the respective locking apertures in the side portions. A succeeding lock bracket is then similarly positioned within the succeeding channel panel to engage the corresponding apertures in the side portion of the succeeding channel panel. When moved to a position transverse to the succeeding channel panel, the lock apertures located within the succeeding lock bracket are engaged by the locking rods of the intermediate lock bracket. This procedure is continued until all of the channel panels are interlocked with one another by means of a plurality of lock brackets.

It is noted that two series of interconnected channel panels may be placed on top of one another to increase the overall height of the sectional wall form system. A joint washer is provided for rigidly securing one series of interconnected channel panels on top of another. Specifically, the joint washer comprises a substantially rectangular configuration having a plurality of apertures located therein for engagement by the locking rods of the lowermost lock bracket of the upper channel panel and for engagement by the locking rods of the uppermost lock bracket of the lower channel panel. The upper series of interconnected channel panels is therefore rigidly connected to the lower series of interconnected channel panels.

A unique tie strap is provided for securing a series of channel panels apart from one another in a face-to-face relationship to define a wall cavity therebetween. After the wall is formed by pouring concrete or the like within the wall cavity, the sectional wall form system is disassembled leaving the plurality of tie straps within the wall thus formed. A plurality of indentations strategically located within the tie strap enable the protruding part of the tie strap to be broken off flush with the wall.

The sectional wall form system of the invention is easily modified to create corners within the wall to be ormed. Specifically, to create an inside corner of the wall, the face portion of one of the channel panels may be longitudinally bent outwardly away from the wall to be formed. Similarly, to form an outside corner of a wall, the face portion of the opposite channel panel may be longitudinally bent inwardly toward the wall to be formed. The inside lock bracket is correspondingly planarly bent to conform to the longitudinal angle of the face portion of the channel panel forming the inside corner. With respect to the channel panel forming the outside corner of the wall, two lock brackets are provided which overlap one another and are secured together by a lock pin such as a bolt.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention reference should be had to the following detailed description taken in connection with the accompanying drawings in which:

FIG. 3 is a perspective view of a lock bracket showing the first and second L-shaped locking rods connected to one side of the lock bracket and the first and second bracket aperture located in the other side of the lock bracket;

FIG. 3A is a side view of FIG. 3;

FIG. 4 is a front view of the series of channel panels illustrating the manner in which the lock brackets are positioned to serially interconnect each of the channel panels;

FIG. 5 is a perspective view of the invention showing a joint washer used to connect two series of channel panels on top of one another;

FIG. 6 is a plan view of the invention showing the placement of two series of channel panels apart from one another to define a wall cavity therebetween; and FIG. 6A is a perspective view of a tie strap showing the two pairs of tie apertures located therein.

Similar reference characters refer to similar parts throughout the several views of the drawings.

DETAILED DESCRIPTION OF THE PREFERRED EMBODIMENT

Figure 1:
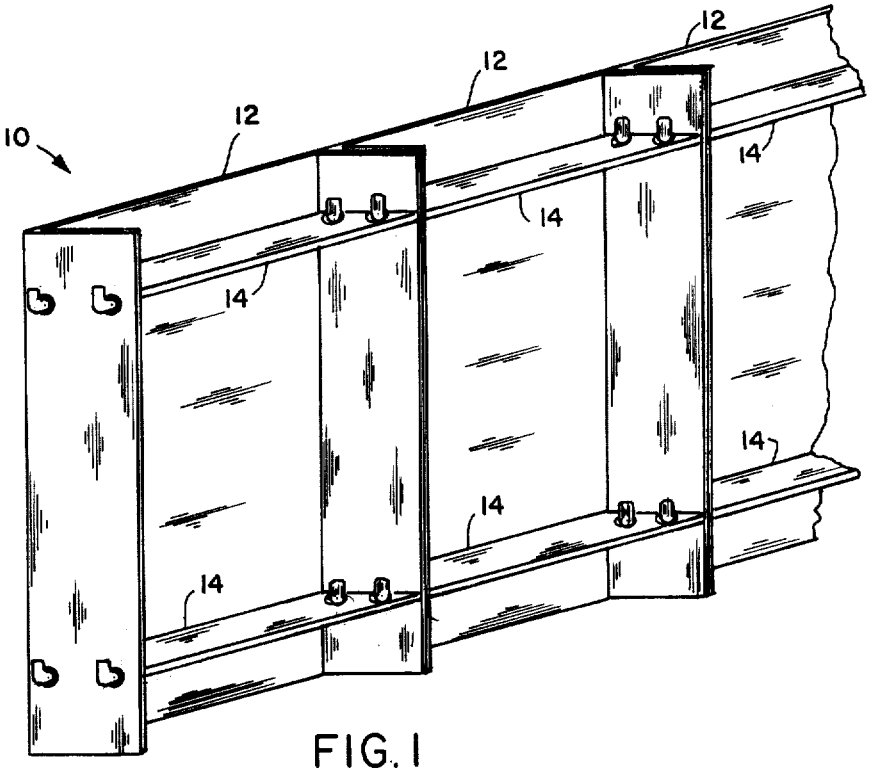
FIG. 1 is a perspective view of the interlocking sectional wall form system of the invention.

FIG. 1 is a perspective view of the interlocking sectional wall form system 10 of the invention. Basically, the wall form system 10 comprises a plurality of channel panels 12 which are serially interlocked together with one another in a side-by-side relationship by means of a plurality of corresponding lock brackets 14. Preferably, upper and lower lock brackets 14 are provided to interconnect the upper and lower portions of each of the channel panels 12. It should be understood, however, that a multiplicity of lock brackets 14 may be incorporated within each of the channel panels 12 to further increase the strength thereof.

Figure 2:
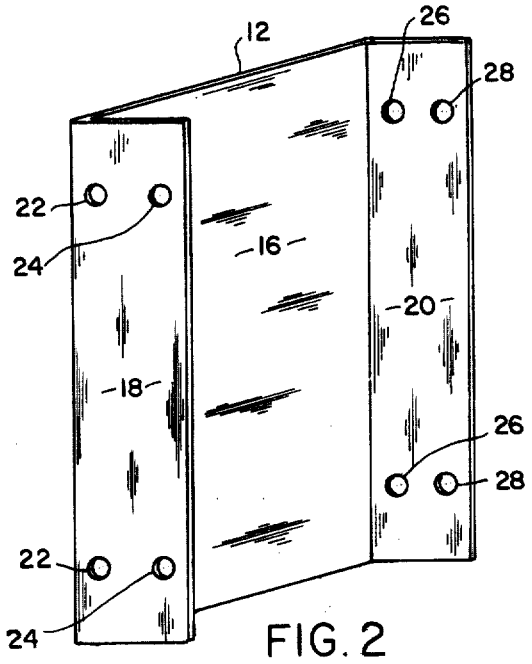
FIG. 2 is a perspective view of an individual channel panel of the invention showing the plurality of lock apertures located within the side portions of the channel panels.

More particularly, as shown in FIG. 2, each of the channel panels 12 comprises a face portion 16 which defines the face of the wall to be formed, and a left and right side portions 18 and 20 which are connected to opposed sides of the face portion 16 and extend therefrom away from the wall to be formed. Preferably, the side portions 18 and 20 are disposed in a right angular relationship to the face portion 16. A first and second lock aperture 22 and 24 is located in the upper and lower portions of the left side portion 18. Similarly, a first and second lock aperture 26 and 28 are located in the upper and lower portions of the right side portion 20. Lock apertures 22–28 are provided for each of the channel panels 12 to facilitate the interlocking of the channel panels 12 by means of the lock bracket 14.

As shown in FIGS. 3 and 3A, the lock bracket 14 comprises a substantially rectangular sheet of rigid material such as steel which is dimensioned to closely fit between the left and right side portions 18 and 20 of the corresponding channel panels 12. A first and second bracket aperture 30 and 32 are located in the right side portion 34 of the lock bracket 14. A first and second locking rods 36 and 38 are connected to the left side portion 40 of the lock bracket 14 by means of a weld 42 or the like. Preferably, the locking rods 36 and 38 are welded to the underside of the lock bracket 14 with the terminal ends 44 and 46 of the locking rods 36 and 38 being angularly bent upwards at right angle bends 48 and 50, respectively.

During assembly, as shown in FIG. 4, the channel panels 12 are positioned adjacent to one another in a side-by-side relationship. The channel panels 12 are then progressively interconnected with one another by positioning lock bracket 14B in a position substantially parallel to the side portions 18 and 20 of the channel panels 12. The terminal ends 44 and 46 of the locking rods 36 and 38 are then respectively inserted into the lock apertures 22 and 24 of the left side portion 18 of the intermediate channel panel 12B and into the lock apertures 26 and 28 of the right side portion 20 of the succeeding channel panel 12C. The intermediate lock bracket 14B is then moved downwardly as shown by arrow 52 to a position transverse to the intermediate channel panel 12B at which time the bracket apertures 30 and 32 of the lock bracket 14B are engaged by the locking rods 36 and 38 of the precedingly installed lock bracket 14A. Such a procedure is repeated for each of the successive channel panels 12 until all of the channel panels 12 are interconnected by respective lock brackets 14. In the preferred embodiment, two series of lock brackets 14 are provided for interconnecting both the upper and lower portions of each channel panel 12. It should be appreciated that the channel panels 12 are quickly assembled without the need of any tools or hardware. Conversely, the channel panels 12 may be quickly disassembled into the component parts thereof. It should also be appreciated that any number of channel panels 12 may be interconnected with one another without departing from the spirit and scope of this invention.

As shown in FIG. 5, a plurality of channel panels 12 may be stacked upon one another if it is desirous to form a wall having a height greater than the height of a single series of channel panels 12. In this case, a joint washer 54 is provided to secure the two series or rows of the channel panels 12 on top of one another. The joint washer 54 comprises a substantially square or rectangular configuration having a plurality of apertures 56 located therein in a particular arrangement enabling the locking rods 36 and 38 of the last lock bracket 14 to engage therein. It is noted that the thickness of the joint washer 54 should be approximately equal to the thickness of the side portions 18 and 20 of the channel panels 12 and the distance between the center of the bracket apertures 30 and 32 and the side edge of the lock bracket 14. Such dimensions would assure that the joint washers are rigidly secured relative to the channel panels 12 by means of the locking rods 36 and 38 of the lock bracket 14.

As shown in FIG. 6, two series of the interconnected channel panels 12 may be placed apart from one another in a face-to-face relationship to define a wall cavity for the wall to be formed. A plurality of tie straps 58 are provided to rigidly secure the two series of channel panels 12 relative to one another. As shown in FIG. 6A, each tie strap 58 comprises two pairs of tie apertures 60 and 62 which enable the locking rods 36 and 38 of the two series of lock brackets 14 to engage therein, thereby securing the two series of interlocked channel panels 12 apart from one another. A plurality of indentations 64 are disposed within the tie strap. The indentations 64 are dimensioned in a spaced apart relationship corresponding to the thickness of the wall to be formed. As the wall form system 10 is assembled, tie straps 58 are strategically placed between the side portions 18 and 20 of a number of pairs of adjoining channel panels 12. After the concrete is poured between the two series of channel panels 12 and is cured, the wall form system 10 is disassembled leaving the tie straps 58 being formed within the wall. The tie straps 58 may then be broken off at indentations 64 thereby leaving its center portion 66 in the wall thus formed. It should be understood that the thickness of the tie strap 58 should be relatively thin such that the tie straps 58 may be installed between the respective channel panels 12 without having to increase the relative length of the locking rods 36 or 38.

The wall form system 10 of the subject invention may be modified to form corners within the wall to be formed. Specifically, the inside corner of the wall is formed by a channel panel 12 as described previously but having its face portion 16 being longitudinally bent outwardly away from the wall to define the corner in the wall. In this case, the lock bracket 14 is similarly planarly bent to conform to the configuration of the face portion 16 such that the lock bracket 14 is insertable between the left and right side portions 18 and 20. The outside corner of a wall may be similarly formed by longitudinally bending the face portion 16 inwardly toward the wall to be formed. With respect to the outside corner, the lock brackets 14 disposed along the face portion 16 of the corner channel panel 12 are overlapped at the corner and secured together by means of a lock pin 72 such as a bolt and nut assembly which is located through bracket apertures 30 and 32. It is noted that the face portion 16 may be longitudinally bent outwardly or inwardly into a right angle relationship to form an inside or outside respectively, right angle corner in the wall to be formed. It should be appreciated that the inside bend 68 and the outside bend 70 may be disposed apart from one another to simultaneously form the inside and outside corners in the wall.

It should be understood that the wall form system 10 of this invention may be utilized in a large variety of applications in addition to the application of forming concrete walls or the like. For example, the sectional wall form system 10 may be used as a bulkhead to support an embankment without departing from the spirit and scope of this invention.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described:

What is claimed is:

1. An interlocking sectional wall form system, comprising in combination:

first and a second channel panels, each of said channel panels having a face portion and a first and a second side portion angularly disposed from said face portion;

first and second channel locking aperture means located in said first and second side portions of said channel panels;

first and second detachable lock brackets;

said first lock bracket being adapted for insertion between said first and second side portions of said first channel panel, said second lock bracket being adapted for insertion between said first and second side portions of said second channel panel;

each of said lock brackets including a first and second side portion;

locking rod means connected to said second side portion of each of said lock brackets; and means for connecting said locking rod means of said first lock bracket through said second locking aperture means of said first channel panel and through said first locking aperture means of said second channel panel for securing said first and second channel panels in an adjacent relationship and means for simultaneously securing said locking rod to said first side portion of said second lock bracket.

2. The interlocking sectional wall form system as set forth in claim 1, wherein said connecting means comprises in combination:

a bracket aperture means located in said first side portion of each of said lock brackets;

a bend disposed in said means of said first lock bracket locking rod for engagement with said bracket aperture means of said second lock bracket, whereby the said first and second channel panels are serially interlocked together in a side-by-side relationship said locking rod means having said bend which engages through said second locking aperture means in the said first channel panel and through the first aperture means of said second channel panel and through said bracket aperture means in the said second lock bracket when the said first lock bracket is moved to a position transverse to the said first channel panel.

3. The sectional wall form system as set forth in claim 1, wherein said channel panel aperture means and said locking bracket aperture means each comprise a plurality of apertures respectively and said locking rod means comprises a plurality of locking rods disposed substantially parallel to each other.

4. The sectional wall form system as set forth in claim 3, further including a joint washer for securing two series of said channel panels on top of one another thereby encasing the height of the sectional wall form system.

5. The sectional wall form system as set forth in claim 4, wherein said joint washer includes a substantially rectangular configuration having a plurality of apertures located therein in a particular arrangement enabling said first and said second locking rods of the last said bracket to engage therethrough when the last said lock bracket is moved to a position transverse to said channel panels.

6. The sectional wall form system as set forth in claim 3, further including a tie strap for securing two series of the interconnected said channel panels apart from one another in a face-to-face relationship.

7. The sectional wall form system as set forth in claim 6, wherein said tie strap includes two pairs of tie apertures enabling said first and second locking rods of one of said lock brackets of one of said series of said channel panels to engage in one pair of said tie apertures and said first and second locking rods of one of said lock brackets of the other said series of said channel panels to engage the other pair of said tie apertures.

8. The sectional wall form system as set forth in claim 1, wherein said first and second side portions are disposed at substantially right angles to said face portion thereby defining a substantially U-shaped cross-section of said channel panel.

9. The sectional wall form system as set forth in claim 1, wherein each of said lock brackets comprises a substantially rectangular configuration dimensioned to closely fit between said first and second side portions of said channel panels.

10. The sectional wall form system as set forth in claim 1, wherein said locking rod means is connected to said lock bracket by means of a weld.

11. The sectional wall form system as set forth in claim 2, wherein said bend comprises a right angle bend.

12. The sectional wall form system as set forth in claim 1, wherein said face portion of one of said channel panels is longitudinally bent inwardly toward the wall to be formed for defining an outside corner in the wall to be formed and wherein two of said lock brackets are overlapped at the outside corner and secured together by a lock pin.

13. The sectional wall form system as set forth in claim 1, wherein said face portion of one of said channel panels is longitudinally bent outwardly away from the wall to be formed for defining an inside corner in the wall to be formed and wherein one of said lock brackets is planarly bent to conform to said bend in said face portion.

14. The sectional wall form system as set forth in claim 9, wherein said face portion is longitudinally bent in a right angle configuration and wherein said lock bracket is planarly bent in a right angle configuration.

* * * * *